US010724113B2

(12) United States Patent
Kern et al.

(10) Patent No.: US 10,724,113 B2
(45) Date of Patent: Jul. 28, 2020

(54) HIGH-STRENGTH FLAT STEEL PRODUCT HAVING A BAINITIC-MARTENSITIC MICROSTRUCTURE AND METHOD FOR PRODUCING SUCH A FLAT STEEL PRODUCT

(71) Applicant: ThyssenKrupp Steel Europe AG, Duisburg (DE)

(72) Inventors: Andreas Kern, Ratingen (DE); Elena Schaffnit, Düsseldorf (DE); Hans-Joachim Tschersich, Dorsten (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 375 days.

(21) Appl. No.: 15/116,958

(22) PCT Filed: Feb. 3, 2015

(86) PCT No.: PCT/EP2015/052135

§ 371 (c)(1),
(2) Date: Aug. 5, 2016

(87) PCT Pub. No.: WO2015/117934

PCT Pub. Date: Aug. 13, 2015

(65) Prior Publication Data

US 2017/0081739 A1 Mar. 23, 2017

(30) Foreign Application Priority Data

Feb. 7, 2014 (EP) ..... 14154354

(51) Int. Cl.

| | |
|---|---|
| ***C22C 38/12*** | (2006.01) |
| ***C22C 38/18*** | (2006.01) |
| ***C22C 38/40*** | (2006.01) |
| ***C22C 38/44*** | (2006.01) |
| ***C22C 38/48*** | (2006.01) |
| ***C22C 38/54*** | (2006.01) |
| ***C21D 6/00*** | (2006.01) |
| ***C21D 8/02*** | (2006.01) |
| ***C21D 9/46*** | (2006.01) |

(Continued)

(52) U.S. Cl.

CPC ..... *C21D 9/46* (2013.01); *C21D 6/002* (2013.01); *C21D 6/005* (2013.01); *C21D 6/008* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/32* (2013.01); *C22C 38/38* (2013.01); *C21D 2211/002* (2013.01); *C21D 2211/008* (2013.01)

(58) Field of Classification Search

CPC ..... C22C 38/04; C22C 38/02; C22C 38/06; C22C 38/001; C22C 38/12; C22C 38/32; C22C 38/44; C22C 38/48; C22C 38/54; C22C 38/22; C22C 38/08; C22C 38/18; C22C 38/26; C22C 38/38; C22C 38/42; C22C 38/46; C22C 38/00; C22C 38/16; C22C 38/20; C22C 38/40; C21D 6/005; C21D 6/002; C21D 6/001; C21D 6/008; C21D 6/004; C21D 2211/008; C21D 2211/002; C21D 8/0263; C21D 8/0226; C21D 8/0205; C21D 8/0247; C21D 8/0447; C21D 8/0426; C21D 9/46; C21D 1/20

USPC ..... 148/654, 320

See application file for complete search history.

(56) References Cited

U.S. PATENT DOCUMENTS

| | | | | |
|---|---|---|---|---|
| 6,245,290 | B1 * | 6/2001 | Koo | C21D 8/0226 148/335 |
| 6,364,968 | B1 * | 4/2002 | Yasuhara | C21D 1/20 148/320 |
| 10,280,477 | B2 * | 5/2019 | Gaganov | C21D 8/0226 |
| 2012/0031528 | A1 * | 2/2012 | Hayashi | C21D 8/0205 148/269 |
| 2016/0010191 | A1 | 1/2016 | Li et al. | |

FOREIGN PATENT DOCUMENTS

| | | | |
|---|---|---|---|
| CN | 103146997 | A1 * | 6/2013 |
| CN | 103205634 | A | 7/2013 |

(Continued)

OTHER PUBLICATIONS

CN103146997A1 machine translation, printed Aug. 24, 2018, 11 pages. (Year: 2013).*

(Continued)

*Primary Examiner* — Matthew E. Hoban
*Assistant Examiner* — Lynne Edmondson
(74) *Attorney, Agent, or Firm* — The Webb Law Firm

(57) ABSTRACT

The disclosed flat steel products have optimal mechanical properties such as high strength and good toughness, but are also well-suited for welding and other manufacturing processes. The steel products may have a ferrite-free microstructure with at least 95% by volume martensite and bainite, with a martensite content of at least 5% by volume, and no more than 5% by volume residual austenite and unavoidable microstructure constituents from the production process. In addition to iron and unavoidable impurities, a composition of the flat steel products may include in percent by weight: 0.08%-0.10% C, 0.015%-0.50% Si, 1.20%-2.00% Mn, 0.020%-0.040% Al, 0.30%-1.00% Cr, 0.20-0.30% Mo, 0.020-0.030% Nb, 0.0015-0.0025% B, up to 0.025% P, up to 0.010% S, and up to 0.006% N. Impurities can include up to 0.12% Cu, up to 0.090% Ni, up to 0.0030% Ti, up to 0.009% V, up to 0.0090% Co, up to 0.004% Sb, and up to 0.0009% W.

7 Claims, No Drawings

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |
| ***C22C 38/32*** | (2006.01) |
| ***C22C 38/38*** | (2006.01) |

(56) References Cited

FOREIGN PATENT DOCUMENTS

| | | | |
|---|---|---|---|
| EP | 1342800 | A1 | 9/2003 |
| EP | 1669470 | A1 | 6/2006 |
| EP | 2524970 | A1 | 11/2012 |
| EP | 2617852 | A1 | 7/2013 |
| EP | 2980255 | A1 | 2/2016 |
| RU | 2203330 | C2 | 4/2003 |
| RU | 2397268 | C2 | 8/2010 |
| RU | 2451764 | C2 | 5/2012 |
| WO | 9838345 | A1 | 9/1998 |
| WO | 03031669 | A1 | 4/2003 |

OTHER PUBLICATIONS

International Search Report for PCT/EP2015/052135 dated Feb. 12, 2015 (dated Feb. 18, 2015).

* cited by examiner

HIGH-STRENGTH FLAT STEEL PRODUCT HAVING A BAINITIC-MARTENSITIC MICROSTRUCTURE AND METHOD FOR PRODUCING SUCH A FLAT STEEL PRODUCT

CROSS REFERENCE TO RELATED APPLICATIONS

This application is a U.S. National Stage Entry of International Patent Application Serial Number PCT/EP2015/052135, filed Feb. 3, 2015, which claims priority to European Patent Application No. 14154354.6 filed Feb. 7, 2014, the entire contents of both of which are incorporated herein by reference.

FIELD

The present disclosure relates to high-strength flat steel products and methods for producing such products.

BACKGROUND

Flat steel products are typically rolled products such as steel strips or sheets, and blanks and plates produced therefrom.

All figures relating to contents of the steel compositions specified in the present application are based on weight, unless explicitly stated otherwise. All otherwise indeterminate percentages in connection with a steel alloy should therefore be understood as figures in "% by weight".

High-strength sheet metal strips are of growing significance since an important role is nowadays played not only by technical performance but also by resource efficiency and climate protection. The reduction in the intrinsic weight of a steel construction can be achieved by the enhancement of the strength properties.

As well as high strength, high-strength steel strips and sheets have to meet high demands on toughness properties and brittle fracture resistance, on cold forming characteristics and on suitability for welding.

Conventional production of the ultrahigh-strength steels consists of rolling, hardening and tempering. In the production of high-strength steel products having a minimum yield strength of 900 MPa, slabs are first cast from a steel melt of suitable composition. The slabs are then hot-rolled to give sheets or strips, which are then cooled under air. The flat steel products obtained have a ferritic-pearlitic microstructure. In order to establish the desired martensitic-bainitic microstructure, the flat steel products are then heated to a temperature above the Ac3 temperature and quenched with water.

To adjust the toughness, in the conventional procedure, the hardening microstructure has to be subjected to a tempering treatment in a further step. The conventional production process thus entails several stages in order to attain the required mechanical properties of the flat steel product to be produced. The large number of operating steps associated with the conventional mode of production leads to comparably high production costs. At the same time, in spite of the complex process sequence, the toughness properties and surface quality of the high-strength flat steel products produced by the conventional route are frequently nonoptimal.

EP 1 669 470 A1 discloses a hot-rolled steel strip having a steel composition comprising (in % by weight) 0.01%-0.2% by weight of C, 0.01%-2% Si, 0.1%-2% Mn, up to 0.1% P, up to 0.03% S, 0.001%-0.1% Al, up to 0.01% N and, as the remainder, Fe and unavoidable impurities. This flat steel product has an essentially homogeneously and continuously cooled microstructure having a mean grain size of 8 μm to 30 μm. In order to achieve this, a slab having the above-specified composition is rough-rolled. The rough-rolled slab obtained is then finally hot-rolled at a hot rolling end temperature at least 50° C. above the Ar3 temperature of the steel to give a hot strip. Subsequently, the finally hot-rolled hot strip, after a delay of at least 0.5 second, is cooled at a cooling rate of at least 80° C./sec from the Ar3 temperature to a coiling temperature of less than 500° C. and finally coiled to a coil.

WO 03/031669 A1 additionally discloses a high-strength thin steel sheet which is deep-drawable and at the same time has excellent shape retention. Furthermore, this publication describes a method of producing such a flat steel product. The steel sheet in question is notable for a particular ratio of x-ray intensities of particular crystallographic orientations and has a particular roughness Ra and a particular coefficient of friction of the steel sheet surface at up to 200° C., and has a lubricant effect. For production of such flat steel products, a hot strip of suitable composition is produced by hot rolling with a total reduction ratio of at least 25% at a temperature within a range between the Ar3 temperature and the Ar3 temperature +100° C. In all flat steel products produced by this method, ferrite is present in the microstructure.

BRIEF DESCRIPTION OF THE TABLES

Table 1 specifies compositions of two steel melts S1 and S2.

Table 2 identifies steels from which hot strips W1-W17 have been produced.

Table 3 identifies the mechanical properties and microstructure constituents for hot strips W1-W17.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element.

That said, the present disclosure concerns flat steel products that can be produced by less-difficult methods and at the same time have not just optimal mechanical properties such as high strength with simultaneously good toughness, but also good suitability for welding. More particularly, such high-strength flat steel products may in some examples have a ferrite-free microstructure consisting predominantly of martensite and bainite, wherein small amounts of residual austenite may additionally be present in the microstructure.

Furthermore, a method of producing such a flat steel product in an inexpensive and operationally reliable manner was to be specified.

A flat steel product of the invention, in the hot-rolled state, has a microstructure which does not include any ferrite but consists to an extent of at least 95% by volume of martensite and bainite with a martensite content of at least 5% by volume. In the microstructure of a flat steel product of the invention, a total of up to 5% by volume of residual austenite and unavoidable microstructure constituents from the production process are permitted.

In this context, a flat steel product of the invention comprises, as well as iron and unavoidable impurities (in % by weight), 0.08%-0.10% C, 0.015%-0.50% Si, 1.20%-2.00% Mn, 0.020%-0.040% Al, 0.30%-1.00% Cr, 0.20%-0.30% Mo, 0.020%-0.030% Nb, 0.0015%-0.0025% B, up to 0.025% P, up to 0.010% S, up to 0.006% N, especially 0.001%-0.006% N. The impurities include up to 0.12% Cu, up to 0.090% Ni, up to 0.0030% Ti, up to 0.009% V, up to 0.0090% Co, up to 0.004% Sb and up to 0.0009% W.

A flat steel product of the invention, in the hot-rolled state, has a minimum yield strength of 900 MPa with simultaneously good fracture elongation. Typically, the yield strengths of flat steel products of the invention are in the range of 900-1200 MPa. Fracture elongation is typically at least 8% and tensile strength is typically 950-1300 MPa. Notch impact energy at −20° C. is likewise typically in the range of 65-115 J. At −40° C., the notch impact energy in the case of flat steel products of the invention is typically 40-120 J.

This combination of properties makes flat steel products of the invention particularly suitable for lightweight construction in the field of utility vehicle manufacture or other applications where the respective structure, with a low intrinsic weight, has to absorb high static or dynamic forces.

A significant advantage of the invention over the known prior art here is that a flat steel product of the invention attains high strength and good toughness in the hot-rolled state without additional heat treatment.

The spectrum of properties optimized in the manner described above is achieved by virtue of steel of the invention having a microstructure composed of bainite and at least 5% by volume of martensite, but no ferrite. The martensite component in the microstructure of the steel of the invention makes a crucial contribution to its strength.

At the same time, the microstructure of the flat steel product of the invention is fine-grained and hence assures good fracture elongation and toughness. Thus, the mean grain size of the microstructure is not more than 20 μm.

A prerequisite for the optimized combination of properties of a flat steel product of the invention is a steel composition balanced in the inventive manner in accordance with the following provisos and elucidations:

C: A flat steel product of the invention contains at least 0.08% by weight of carbon, in order that the desired strength properties are achieved. At the same time, the carbon content is restricted to not more than 0.10% by weight, in order to avoid adverse effects on toughness properties, weldability and deformability.

Si: Silicon firstly serves as a deoxidizing agent in the production of the steel of which a flat steel product of the invention consists. Secondly, it contributes to enhancing the strength properties. In order to achieve this, at least 0.015% by weight of Si is required in the flat steel product of the invention. When the silicon content is too high, however, the toughness properties and toughness in the heat-affected zone or weldability are greatly impaired. For this reason, the Si content should not exceed the upper limit of 0.50% by weight in a flat steel product of the invention. Adverse effects of the presence of Si on surface quality can be reliably avoided by limiting the Si content to not more than 0.25% by weight.

Mn: Manganese in contents of 1.20%-2.0% by weight contributes to the flat steel product of the invention having the desired strength properties coupled with good toughness properties. When the Mn content is less than 1.20% by weight, the strength properties are not attained. If the maximum manganese content exceeds 2.0% by weight, there is the risk that weldability, toughness properties, deformability and segregation characteristics will deteriorate.

P: Relatively high contents of phosphorus, an accompanying element, would worsen the notch impact energy and deformability of a flat steel product of the invention. Therefore, the phosphorus content is limited to not more than 0.025% by weight. Adverse effects of the presence of P are ruled out in a particularly reliable manner when the P content is limited to less than 0.015% by weight.

S: Relatively high S contents can also impair the notch impact energy and deformability of a flat steel product of the invention as a result of the formation of MnS. For this reason, the sulfur content of a flat steel product of the invention is limited to not more than 0.010% by weight, especially less than 0.010% by weight, adverse effects of S being ruled out in a particularly reliable manner when the S content is limited to not more than 0.003% by weight. Desulfurization can be brought about during steel production in a known manner, for example by a CaSi treatment.

Al: Aluminum is used as a deoxidizing agent in the melting of the steel of which a flat steel product of the invention consists, and, as a result of AlN formation, hinders coarsening of the austenite grain in the course of austenitization. In this way, the presence of Al in the amounts specified in accordance with the invention promotes the formation of a fine-grain microstructure which is to the benefit of the mechanical properties of a flat steel product of the invention. If the aluminum content is below 0.020% by weight, the deoxidation processes required do not proceed to completion. However, if the aluminum content exceeds the upper limit of 0.040% by weight, $Al_2O_3$ precipitates can form. These would in turn have an adverse effect on the purity level and toughness properties of the steel material of which each flat steel product of the invention consists.

N: Nitrogen, an accompanying element, forms aluminum nitride together with Al. It, however, the nitrogen content is too high, the toughness properties will deteriorate. In order to exploit the advantageous effect of N, at least 0.001% by weight of N may be provided in the steel. In order to avoid adverse effects at the same time, the upper limit in the N contents in a flat steel product of the invention has been fixed at 0.006% by weight.

Cr: The addition of chromium to the steel of which a flat steel product of the invention consists improves the strength properties thereof. For this purpose, at least 0.30% by weight of Cr is required. If, however, the chromium content is too high, weldability and toughness in the heat-affected zone are adversely affected. Therefore, in accordance with the invention, the upper limit in the range of Cr contents is set at 1.0% by weight.

Mo: Molybdenum increases strength and improves hardness. In order to exploit this, in accordance with the invention, the steel of which a flat steel product of the invention consists includes at least 0.20% by weight of Mo. However, if molybdenum is added in too high a proportion, in the case of welding, there is a deterioration in the toughness in the region of the heat-affected zone of the particular weld seam. Therefore, the upper limit in the molybdenum content, in accordance with the invention, is fixed at 0.30%.

Nb: Niobium is present in a flat steel product of the invention in order to promote strength properties by virtue of austenite grain refining. This effect occurs when the Nb content is 0.020%-0.030% by weight. If the upper limit of this range is exceeded, there will be a deterioration in weldability and toughness in the heat-affected zone of a welding operation undertaken in a flat steel product of the invention.

B: The boron content of the steel in a flat steel product of the invention is 0.0015%-0.0025% by weight, in order to optimize the strength property and hardenability of a flat steel product of the invention. Excessively high boron contents worsen the toughness properties, whereas the positive effects thereof are not perceptible when B contents are too low.

Copper, nickel, titanium, vanadium, cobalt, tungsten and antimony are not included deliberately in the steel alloy of which a flat steel product of the invention consists but occur as unavoidable accompanying elements from the production process. In particular, the Cu content is limited to 0.12% by weight, in order to avoid adverse effects on weldability and toughness in the heat-affected zone of a welding operation undertaken on the flat steel product. The other aforementioned alloy constituents that are unavoidably present from the production process should each likewise be limited in terms of their contents such that none has any effect on the properties of the flat steel product of the invention.

The respective C content % C, the respective Mn content % Mn, the respective Cr content % Cr, the respective Mo content % Mo, the respective V content % V, the respective Cu content % Cu and the respective Ni content % Ni of the steel composition of the invention, each in % by weight, are optimally adjusted such that the carbon equivalent $CE_{\|W}$, calculated by the formula $$CE_{\|W}=\%\ C+\%\ Mn/6+(\%\ Cr+\%\ Mo+\%\ V)/5+(\%\ Cu+\%\ Ni)/15,$$

fulfills the following condition:

$$CE_{\|W}\leq 0.5$$

Such a balance of the alloy contents of a flat steel product of the invention achieves particularly good weldability.

For the production of a flat steel product having the characteristics of the invention, according to the invention, the following operating steps are executed:

a) casting a steel melt comprising, as well as iron and unavoidable impurities (in % by weight),
C: 0.08%-0.10%
Si: 0.015%-0.50%
Mn: 1.20%-2.00%
Al: 0.020%-0.040%
Cr: 0.30%-1.00%
Mo: 0.20%-0.30%
Nb: 0.020%-0.030%
B: 0.0015%-0.0025%
P: up to 0.025%
S: up to 0.010%
N: up to 0.006%, especially 0.001%-0.006%,
to give a slab, b) if necessary heating the slab to an austenitization temperature of 1200-1300° C., c) rough-rolling the slab heated in such a way at a rough rolling temperature of 950-1250° C., where the total deformation $e_V$ achieved by means of the rough rolling is at least 50%, d) finally hot-rolling the rough-rolled slab to give a hot strip, the final rolling temperature in the hot rolling being 810-875° C., the total deformation $e_F$ achieved by means of the final rolling being at least 70%, and the hot rolling being effected without wetting the rolling material with lubricant, e) intensively cooling the finally hot-rolled hot strip at a cooling rate of at least 40 K/s to a coiling temperature of 200-500° C., the cooling setting in within 10 s after the end of the hot rolling, f) coiling the hot strip that has been cooled down to the coiling temperature.

In the course of the process according to the invention, first of all, a steel melt which has been alloyed in accordance with the above-summarized elucidations relating to the influences of the individual alloy elements is used to cast slabs, which are then, if they have been cooled down to too low a temperature beforehand, reinstated to an austenitization temperature of 1200° C. to 1300° C. The lower limit of the range to be observed in accordance with the invention for the austenitization temperature is fixed such that the complete dissolution of alloy elements in the austenite and the homogenization of the microstructure are assured. The upper limit of the range for the austenitization temperature should not be exceeded, in order to avoid coarsening of the austenite grain and increased scale formation.

According to the invention, the rough rolling temperature is in the temperature range from 950° C. to 1250° C.

The rough rolling is effected with a total deformation $e_V$ of at least 50%, where the total deformation ev, i.e. the sum total of the drafts achieved by means of the rough rolling in the case of a rough rolling operation conducted in two or more drafts, is calculated by the following formula:

$$e_V=(h0-h1)/h0*100\%$$

with h0: entry thickness of the rolling material in the rough rolling in mm,
h1: exit thickness of the rolling material in the rough rolling in mm.

The lower limit of the rough rolling temperature range and the minimum value of the sum total of the drafts achieved by means of the rough rolling (total deformation $e_V$) are fixed such that the recrystallization processes can still proceed to completion. Before the final rolling, this gives rise to a fine-grain austenite that has a positive effect on the toughness properties and the fracture elongation.

According to the invention, the final rolling temperature in the hot rolling operation conducted in a rolling relay typically comprising several rolling stands is 810° C. to 875° C. The upper limit of the range specified in accordance with the invention for the final rolling temperature is fixed such that no recrystallization of the austenite takes place in the course of rolling in the final hot rolling mill. Accordingly, a fine-grain microstructure forms after the phase transformation. The lower limit of the range of the final rolling temperature is 810° C. At this temperature, there is still no formation of ferrite in the course of hot rolling, such that the hot strip is ferrite-free on exit from the hot rolling mill.

The total deformation $e_F$ achieved overall by the subsequent rolling steps in the final hot rolling is, in accordance with the invention, at least 70%, where the total deformation $e_F$ here is calculated by the formula $$e_F=(h0-h1)/h0*100\%$$

with h0: thickness of the rolling material on entry into the final hot rolling relay in mm,
h1: thickness of the rolling material on exit from the final hot rolling relay in mm.

The high total deformation $e_F$ achievable in accordance with the invention by means of the final hot rolling causes the phase transformation from highly deformed austenite to take place. This has a positive effect on the grain fineness, such that small particle sizes are present in the microstructure of the flat steel product produced in accordance with the invention.

The hot rolling is followed by intensive cooling which sets in within 10 s after the end of the hot rolling and is continued at cooling rates of at least 40 K/s until the coiling temperature of 200° C. to 500° C. required in each case has been attained. This gives rise, in accordance with the present invention, to a bainitic-martensitic microstructure having a microstructure component of bainite and martensite which adds up to at least 95% by volume immediately prior to coiling. The cooling is effected here so quickly that no ferrite forms in the microstructure of the hot-rolled flat steel product on the way to the coiling. The cooling rate, in the course of the cooling conducted after the hot rolling and prior to the coiling, should not be less than 40 K/s, in order to avoid the formation of unwanted microstructure constituents, for example ferrite. The upper limit for the cooling rate is in practice 75° K/s and should not be exceeded, in order to ensure optimal evenness of the flat steel product produced in accordance with the invention.

The delay between the end of the hot rolling and the commencement of cooling should not exceed 10 s, in order to avoid formation of unwanted microstructure constituents in the flat steel product here too.

The microstructure of the hot-rolled flat steel product of the invention thus cooled, on arrival at the coiling station where the flat steel product is wound to a coil, already consists regularly to an extent of at least 95% by volume of bainite and martensite.

The range of the coiling temperature stipulated in accordance with the invention is selected such that the target bainitic-martensitic microstructure is reliably present in the finished flat steel product of the invention. At a coiling temperature above 500° C., the desired bainitic-martensitic microstructure would not be achieved, with the result that the mechanical properties desired in accordance with the invention, such as high strength and toughness, would not be achieved either. The temperature should not go below the lower limit of the coiling temperature, in order to assure optimal evenness and an optimal surface of the flat steel product of the invention without subsequent treatment, and at the same time to achieve the desired tempering effect in the coil.

During the coiling and in the course of subsequent cooling in the coil, the residual microstructure constituents that are present alongside bainite and martensite until that point are transformed to martensite, bainite or residual austenite and other constituents that are unavoidable from the production process but are ineffective with regard to the properties of the flat steel product of the invention.

The thickness of hot-rolled flat steel products produced in accordance with the invention is typically 2-12 mm.

In the course of production of high-strength flat steel products of the invention, the hot strip produced in each case is consequently, while still hot directly from the rolling after the thermomechanical rolling which is accomplished by the combination of a rough rolling conducted in accordance with the invention with a final hot rolling likewise conducted in accordance with the invention, cooled at high cooling rates in such a way that the desired microstructure and consequently the mechanical properties are established without subsequent heat treatment.

Since the hot rolling in the hot rolling finishing train, in accordance with the invention, is deliberately effected without application of lubricant to the hot strip, the surface of the flat steel product is free of lubricant on exit from the hot rolling relay. Dispensing with lubricant has the advantage that the inconvenience associated with the application of lubricant in the rolling process is eliminated and hence higher economic viability of the overall process is assured. At the same time, dispensing with lubricant protects resources and minimizes environmental and climate pollution.

At the same time, the procedure of the invention, in the production of flat steel products of the invention, has the advantage that the phase transformation takes place after the end of the hot rolling from a displacement-rich austenite at high cooling rates. In this way, a fine-grain bainitic-martensitic microstructure and good toughness and/or fracture elongation properties are achieved. At the same time, the method of the invention requires a composition of the flat steel product produced in accordance with the invention which is notable for inexpensive alloy elements present in comparably low contents. Costly and rare alloy elements are not required for the production of a flat steel product of the invention, and so the production costs associated with the production of flat steel products of the invention are minimized in this respect too. At the same time, the alloy concept based on minimized alloy contents in accordance with the invention contributes to optimal weldability of flat steel products of the invention.

Because of the absence of the heat treatment, the surface characteristics of hot-rolled flat steel products of the invention are improved over conventionally produced high-strength hot strips. At the same time, the production costs are reduced.

As a result of the small number of operating steps and the omission of lubrication during the hot rolling, the environmental pollution associated with the production of flat steel products of the invention is likewise reduced.

The production pathway envisaged in accordance with the invention is also much simpler, such that it can be conducted with a low level of difficulty and reliable success.

One of the essential features of the procedure of the invention is consequently that the mechanical properties are established by the rolling process, the subsequent rapid cooling and the coiling. Further heat treatments after coiling are unnecessary in the procedure of the invention, in order to establish the desired properties of the respective flat steel product of the invention. The high toughness and fracture elongation of a flat steel product of the invention is instead achieved without subsequent heat treatment.

The invention thus provides a flat steel product having a minimum yield strength of 900 MPa, having a spectrum of properties that make it particularly suitable for lightweight construction of utility vehicle bodies and other body parts that are subject to high stresses in use.

The use of flat steel products of the invention in the construction of utility vehicles thus makes it possible to produce components having improved surface qualities, lower weight and optimal characteristics under static and dynamic load, especially in the event of a crash. By consistent exploitation of these advantages, it is possible with the aid of flat steel products of the invention to manufacture vehicles which do not just have a low weight and enable an associated reduction in the energy consumption that occurs in the operation of the particular vehicle, but wherein the payload is also increased and hence utilization of energy based on the load weight is optimized.

The invention is elucidated in detail by working examples hereinafter.

In the laboratory, two steel melts S1, S2 have been produced, the compositions of which are specified in table 1.

The melts S1, S2 have each been cast to slabs. Because of laboratory conditions, the dimensions of the slabs cast from each of the steels S1, S2 were each 150 mm×150 mm×500 mm.

Subsequently, the slabs have each been heated to an austenitization temperature $T_A$.

The slabs thus heated or kept at the particular austenitization temperature $T_A$ have then been rough-rolled at rough rolling temperatures $T_V$ and rough rolling deformations $e_V$ and then hot-rolled at final rolling deformations $e_F$ and hot rolling end temperatures $T_{WE}$ to give hot strips W1-W17 having a thickness d of 3-10 mm.

Within 3 s after the end of the hot rolling, the hot strips W1-W17 obtained have been cooled in an accelerated manner at a cooling rate dT to a coiling temperature $T_H$ at which they have subsequently each been coiled to a coil.

For each of the hot strips W1-W17 coiled to a respective coil, table 2 states the steel from which the respective hot strip W1-W17 has been produced, and the respective austenitization temperature $T_A$ set, the rough rolling temperature $T_V$, the rough rolling deformation $e_V$, the hot rolling end temperature $T_{WE}$, the total deformation $e_F$ achieved by means of the final hot rolling, the thickness d, the cooling rate dT and the coiling temperature $T_H$.

After the cooling in the coil, the mechanical properties and the microstructure of the hot strips W1-W17 have been examined. The tensile tests to determine the yield strength $R_{eH}$, tensile strength $R_m$ and fracture elongation A have been conducted in accordance with DIN EN ISO 6892-1 on longitudinal specimens. The notched impact bending tests to determine the notch impact energy Av at −20° C. and −40° C. have been conducted on longitudinal samples as per according to DIN EN ISO 148-1.

The microstructure was examined by means of light microscopy and scanning electron microscopy on longitudinal sections. For this purpose, the samples were taken from a quarter of the width of the hot strips W1-W17 and etched with Nital or sodium disulfite.

The microstructure constituents were determined by means of a surface analysis described by H. Schumann and H. Oettel in "Metallografie" [Metallography] 14th edition, 2005 WILEY-VCH Verlag GmbH & Co. KGaA, Weinheim, in a sample location of ⅓ sheet thickness.

The mechanical properties and microstructure constituents thus determined are summarized in table 3. It is found that the hot strips W1-W17 produced in accordance with the invention have high strength properties coupled with good toughness properties and good fracture elongation.

The microstructure of the hot strips W1-W9 produced in accordance with the invention and of the hot strips W12-W16 likewise produced in accordance with the invention has between 5% and 33% martensite, with the remainder in each case consisting of bainite. The hot strips produced in accordance with the invention each have high strength values in combination with good elongation properties.

By contrast, in the case of the hot strips W10 (cooling rate dT too low), W11 (hot rolling end temperature $T_{WE}$ too high) and W17 (coiling temperature $T_H$ too high) that have not been produced in accordance with the invention, the microstructure consists solely of bainite. As a result, the noninventive hot strips W10, W11 and W17 do not attain the optimal combination of properties featured by the hot strips W1-W9 and W12-W16 produced in accordance with the invention.

TABLE 1

| | Chemical composition*) | | | | | | | | | | | |
|---|---|---|---|---|---|---|---|---|---|---|---|---|
| Steel | C | Si | Mn | P | S | Al | N | Cr | Mo | Nb | B | Cu |
| S1 | 0.09 | 0.41 | 1.81 | 0.004 | 0.002 | 0.031 | 0.0018 | 0.35 | 0.25 | 0.025 | 0.0022 | 0.01 |
| S2 | 0.09 | 0.20 | 1.47 | 0.004 | 0.001 | 0.030 | 0.0021 | 0.36 | 0.25 | 0.024 | 0.0020 | 0.01 |

*)Figures in % by weight, remainder: iron and unavoidable impurities including ineffective traces of Ni, Ti, V, Co, Sb, W

TABLE 2

| No. | Steel | $T_A$ [° C.] | $T_V$ [° C.] | $e_V$ [%] | $T_{WE}$ [° C.] | $e_F$ [%] | dT [K/s] | $T_H$ [° C.] | d [mm] |
|---|---|---|---|---|---|---|---|---|---|
| W1 | S1 | 1250 | 1070 | 57 | 810 | 80 | 75 | 500 | 6 |
| W2 | S1 | 1250 | 1050 | 57 | 875 | 80 | 75 | 440 | 6 |
| W3 | S1 | 1250 | 1065 | 57 | 820 | 80 | 75 | 440 | 6 |
| W4 | S1 | 1250 | 1060 | 57 | 860 | 80 | 75 | 240 | 6 |
| W5 | S1 | 1250 | 1050 | 57 | 820 | 80 | 40 | 400 | 6 |
| W6 | S1 | 1250 | 1050 | 57 | 815 | 80 | 40 | 360 | 6 |
| W7 | S1 | 1300 | 1050 | 57 | 820 | 80 | 40 | 460 | 6 |
| W8 | S1 | 1200 | 1100 | 64 | 860 | 88 | 50 | 490 | 3 |
| W9 | S1 | 1200 | 1080 | 50 | 810 | 71 | 75 | 400 | 10 |
| W10 | S1 | 1250 | 1055 | 57 | 840 | 80 | 30 | 450 | 6 |
| W11 | S1 | 1250 | 1055 | 43 | 900 | 85 | 40 | 500 | 6 |
| W12 | S2 | 1250 | 1050 | 57 | 810 | 80 | 40 | 340 | 6 |
| W13 | S2 | 1250 | 1075 | 57 | 810 | 80 | 70 | 520 | 6 |
| W14 | S2 | 1250 | 1055 | 57 | 810 | 80 | 75 | 405 | 6 |
| W15 | S2 | 1250 | 980 | 57 | 810 | 73 | 65 | 450 | 8 |
| W16 | S2 | 1200 | 1090 | 64 | 860 | 84 | 70 | 500 | 4 |
| W17 | S2 | 1250 | 1035 | 57 | 810 | 80 | 60 | 550 | 6 |

TABLE 3

| | | Tensile test, longitudinal | | | Notched impact bending test, longitudinal | | Microstructure |
|---|---|---|---|---|---|---|---|
| No. | Steel | ReH [MPa] | Rm [MPa] | A [%] | Av-20° C. [J] | Av-40° C. [J] | constituents [% by vol.] |
| W1 | S1 | 910 | 954 | 10 | 82 | 67 | 5% martensite + bainite |
| W2 | S1 | 1062 | 1081 | 9 | 132 | 128 | 17% martensite + bainite |
| W3 | S1 | 1143 | 1156 | 9 | 76 | 54 | 25% martensite + bainite |
| W4 | S1 | 1081 | 1087 | 9 | 101 | 75 | 33% martensite + bainite |
| W5 | S1 | 1057 | 1116 | 8 | 118 | 92 | 24% martensite + bainite |
| W6 | S1 | 1072 | 1091 | 9 | 101 | 84 | 20% martensite + bainite |

TABLE 3-continued

| No. | Steel | Tensile test, longitudinal ReH [MPa] | Rm [MPa] | A [%] | Notched impact bending test, longitudinal Av-20° C. [J] | Av-40° C. [J] | Microstructure constituents [% by vol.] |
|---|---|---|---|---|---|---|---|
| W7 | S1 | 949 | 987 | 9 | 95 | 42 | 8% martensite + bainite |
| W8 | S1 | 983 | 1031 | 11 | n.d. *) | n.d. *) | 6% martensite + bainite |
| W9 | S1 | 1012 | 1062 | 10 | 98 | 67 | 15% martensite + bainite |
| W10 | S1 | 721 | 912 | 11 | 117 | 84 | bainite |
| W11 | S1 | 575 | 844 | 14 | 38 | 44 | bainite |
| W12 | S2 | 1084 | 1140 | 8 | 115 | 121 | 28% martensite + bainite |
| W13 | S2 | 1088 | 1121 | 11 | 66 | 50 | 15% martensite + bainite |
| W14 | S2 | 1107 | 1158 | 9 | 91 | 40 | 20% martensite + bainite |
| W15 | S2 | 1043 | 1096 | 10 | 70 | 59 | 12% martensite + bainite |
| W16 | S2 | 972 | 1032 | 11 | n.d. *) | n.d. *) | 5% martensite + bainite |
| W17 | S2 | 671 | 764 | 15 | 116 | 65 | bainite |

*) "n.d." = not determined

The invention claimed is:

1. A flat steel product having a thickness of 4-12 mm and comprising:

a ferrite-free bainitic-martensitic microstructure having at least 95 percent by volume martensite and bainite, with a martensite content of at least 5 percent by volume, wherein a remainder of the ferrite-free microstructure has up to 5 percent by volume residual austenite and unavoidable microstructure constituents from a production process; and a composition that includes the following in addition to iron and unavoidable impurities:

0.08%-0.10% by weight C;
0.015%-0.50% by weight Si;
1.20%-2.00% by weight Mn;
0.020%-0.040% by weight Al;
0.30%-1.00% by weight Cr;
0.20%-0.30% by weight Mo;
0.020%-0.030% by weight Nb;
0.0015%-0.0025% by weight B;
up to 0.025% by weight P;
up to 0.010% by weight S; and
up to 0.006% by weight N,
wherein the impurities include
up to 0.12% by weight Cu,
up to 0.090% by weight Ni,
up to 0.0030% by weight Ti,
up to 0.009% by weight V,
up to 0.0090% by weight Co,
up to 0.004% by weight Sb, and
up to 0.0009% by weight W, and wherein the flat steel product in an as-hot-rolled state has a yield strength of at least 900 MPa, a notch impact energy at −20° C. of 65-132 J, and at −40° C. of 40-128 J.

2. The flat steel product of claim 1 wherein for a carbon equivalent $CE_{||W}$ of the composition:

$$CE_{||W} \leq 0.5 \text{ and}$$

$$CE_{||W} = \%\,C + \%\,Mn/6 + (\%\,Cr + \%\,Mo + \%\,V)/5 + (\%\,Cu + \%\,Ni)/15 \text{ wherein}$$

% C is a respective C content in % by weight,
% Mn is a respective Mn content in % by weight,
% Cr is a respective Cr content in % by weight,
% Mo is a respective Mo content in % by weight,
% V is a respective V content in % by weight,
% Cu is a respective Cu content in % by weight, and
% Ni is a respective Ni content in % by weight.

3. The flat steel product of claim 1 wherein the composition comprises less than or equal to 0.25% by weight Si.

4. The flat steel product of claim 1 wherein the composition comprises at least 0.001% by weight N.

5. A method for producing a flat steel product having a thickness of 2-12 mm and, the method comprising:

casting a steel melt to form a slab, with the steel melt comprising in addition to iron and unavoidable impurities:

0.08%-0.10% by weight C,
0.015%-0.50% by weight Si,
1.20%-2.00% by weight Mn,
0.020%-0.040% by weight Al,
0.30%-1.00% by weight Cr,
0.20%-0.30% by weight Mo,
0.020%-0.030% by weight Nb,
0.0015%-0.0025% by weight B,
up to 0.025% by weight P,
up to 0.010% by weight S, and
up to 0.006% by weight N,
wherein the impurities include
up to 0.12% by weight Cu,
up to 0.090% by weight Ni,
up to 0.0030% by weight Ti,
up to 0.009% by weight V,
up to 0.0090% by weight Co,
up to 0.004% by weight Sb, and
up to 0.0009% by weight W;

heating the slab to an austenitization temperature of 1200-1300 degrees Celsius;

rough rolling the slab heated at a rough rolling temperature of 950-1250 degrees Celsius, wherein a total deformation achieved by the rough rolling is at least 50%;

hot rolling the rough-rolled slab to form a hot strip, wherein a final rolling temperature in the hot rolling is 810-875 degrees Celsius, wherein a total deformation achieved by the hot rolling is at least 70%, wherein the hot rolling occurs without wetting rolling material with lubricant;

cooling the hot-rolled hot strip at a cooling rate of at least 40 K/s to a coiling temperature of 200-500 degrees Celsius, wherein cooling sets in within 10 seconds following the hot rolling; and coiling the hot strip that has been cooled down to the coiling temperature.

6. The method of claim 5 wherein the steel melt comprises at least 0.001% by weight N.

7. The method of claim 5 wherein, after coiling, the flat steel product has ferrite-free, bainitic-martensitic microstructure having at least 95 percent by volume martensite and bainite, with a martensite content of at least 5 percent by volume, wherein a remainder of the ferrite-free microstructure has up to 5 percent by volume residual austenite and unavoidable microstructure constituents resulting from processing.

* * * * *